US005386808A

United States Patent [19]

Koch

[11] Patent Number: 5,386,808

[45] Date of Patent: Feb. 7, 1995

[54] CAMSHAFT DRIVE FOR AN INTERNAL-COMBUSTION V-ENGINE

[75] Inventor: Alfred Koch, Weissach, Germany

[73] Assignee: Dr. Ing, h.c.f. Porsche AG, Weissach, Germany

[21] Appl. No.: 104,064

[22] PCT Filed: Jan. 26, 1991

[86] PCT No.: PCT/EP91/00151

§ 371 Date: Aug. 13, 1993

§ 102(e) Date: Aug. 13, 1993

[51] Int. Cl.[6] ..... F01L 1/02

[52] U.S. Cl. ..... 123/90.31

[58] Field of Search ..... 123/90.31

[56] References Cited

U.S. PATENT DOCUMENTS

| | | | |
|---|---|---|---|
| 4,957,077 | 9/1990 | Okitsu et al. | 123/90.31 |
| 4,966,106 | 10/1990 | Aruga et al. | 123/90.31 |
| 5,010,859 | 4/1991 | Ogami et al. | 123/90.31 |
| 5,012,773 | 5/1991 | Akasaka et al. | 123/90.31 |
| 5,033,421 | 7/1991 | Shimada et al. | 123/90.31 |
| 5,178,108 | 1/1993 | Beaber | 123/90.31 |
| 5,216,989 | 6/1993 | Iwata et al. | 123/90.31 |
| 5,295,459 | 3/1994 | Suzuki et al. | 123/90.31 |

FOREIGN PATENT DOCUMENTS

| | | |
|---|---|---|
| 0406527 | 4/1990 | European Pat. Off. . |
| 8813425 | 12/1988 | Germany . |
| 3347638 | 2/1989 | Germany . |
| 2-207142 | 11/1990 | Japan . |

*Primary Examiner*—E. Rollins Cross
*Assistant Examiner*—Weilun Lo
*Attorney, Agent, or Firm*—Evenson, McKeown, Edwards and Lenahan

[57] ABSTRACT

A camshaft drive for an internal-combustion engine with a V-shaped cylinder arrangement has two output wheels on the crankshaft, one of each respectively being assigned to a cylinder bank. The distance of the output wheels corresponds to an offset of the cylinder banks with respect to one another and permits the use of identical parts.

5 Claims, 3 Drawing Sheets

CAMSHAFT DRIVE FOR AN INTERNAL-COMBUSTION V-ENGINE

BACKGROUND AND SUMMARY OF THE INVENTION

The present invention relates to a camshaft drive for an internal-combustion V-engine having at least one overhead camshaft for each cylinder bank, driving wheels which are arranged on the camshafts and each driven by output wheels which are non-rotatably mounted on a crankshaft. A first output wheel in a driving connection with the camshafts on one cylinder bank and a second output wheel is in a driving connection with the camshafts of the other cylinder bank.

In German Patent Document DE-33 47 638 C, an internal-combustion engine of the above-described type is disclosed which has cylinder banks that are arranged in a V-shape with respect to one another and whose respective two overhead camshafts are driven by a single double-row timing chain. Because of the overlapping of the driving wheels of two adjacent camshafts respectively and because of the offset of the cylinder banks with respect to one another in the longitudinal direction of the internal-combustion engine, it is not possible to use identical camshafts.

It is known from German Patent Document DE 88 13 425 U to use two identical cylinder heads in an internal-combustion V-engine, which cylinder heads are rotated with respect to one another by 180 degrees. Because of the drive of a camshaft of each cylinder bank on a front end of the internal-combustion engine, these camshafts have different constructions.

An object of the present invention is to provide a camshaft drive in an internal-combustion engine of the above-described type, which has a number of different components that is as small as possible and which optimally utilizes an existing installation space.

This and other objects are achieved by the present invention which provides a camshaft drive for an internal-combustion V-engine that has at least two cylinder banks, and comprises at least one overhead camshaft for each cylinder bank, a crankshaft, and a first output wheel non-rotatably mounted on the crankshaft and drivingly connected with the camshaft of one cylinder bank and a second output wheel non-rotatably mounted on the crankshaft and drivingly connected with the camshaft of the other cylinder bank. First and second driving wheels are mounted on the camshafts and are driveably coupled to at least one of the first and second output wheels. An additional output is arranged between the first and second output wheels. The cylinder banks are offset from one another in a longitudinal direction of the V-engine, and the first and second output wheels are separated from one another in the longitudinal direction on the crankshaft by a distance that is approximately identical to the offset of the cylinder banks. All of the driving wheels are identical parts.

In internal-combustion engines with cylinder banks that are arranged at an arbitrary angle in a V-shape with respect to one another, this camshaft drive permits the use of identical camshafts for both cylinder banks. This advantage applies particularly to internal-combustion engines with several camshafts for each cylinder bank. Identical driving wheels, which are constructed as identical parts, are arranged on all camshafts. The use of identical camshafts is achieved by an offset between the output wheels which are arranged on the crankshaft and are assigned to the cylinder banks, which corresponds to the offset of the cylinder banks with respect to one another. In certain embodiments of the invention, the installation space on the crankshaft which is created between the output wheels is used for the arrangement of a gearwheel which drives an oil pump arranged at a distance to the crankshaft or coaxial with respect to this gearwheel.

Other objects, advantages and novel features of the present invention will become apparent from the following detailed description of the invention when considered in conjunction with the accompanying drawings.

DETAILED DESCRIPTION OF THE DRAWINGS

An internal-combustion engine 3 which is equipped with two cylinder banks 1, 2 arranged in a V-shape with respect to one another has a crankshaft 4 as well as overhead camshafts 5, 6 and 7, 8 assigned to the respective cylinder banks 1 and 2.

Figure 1:
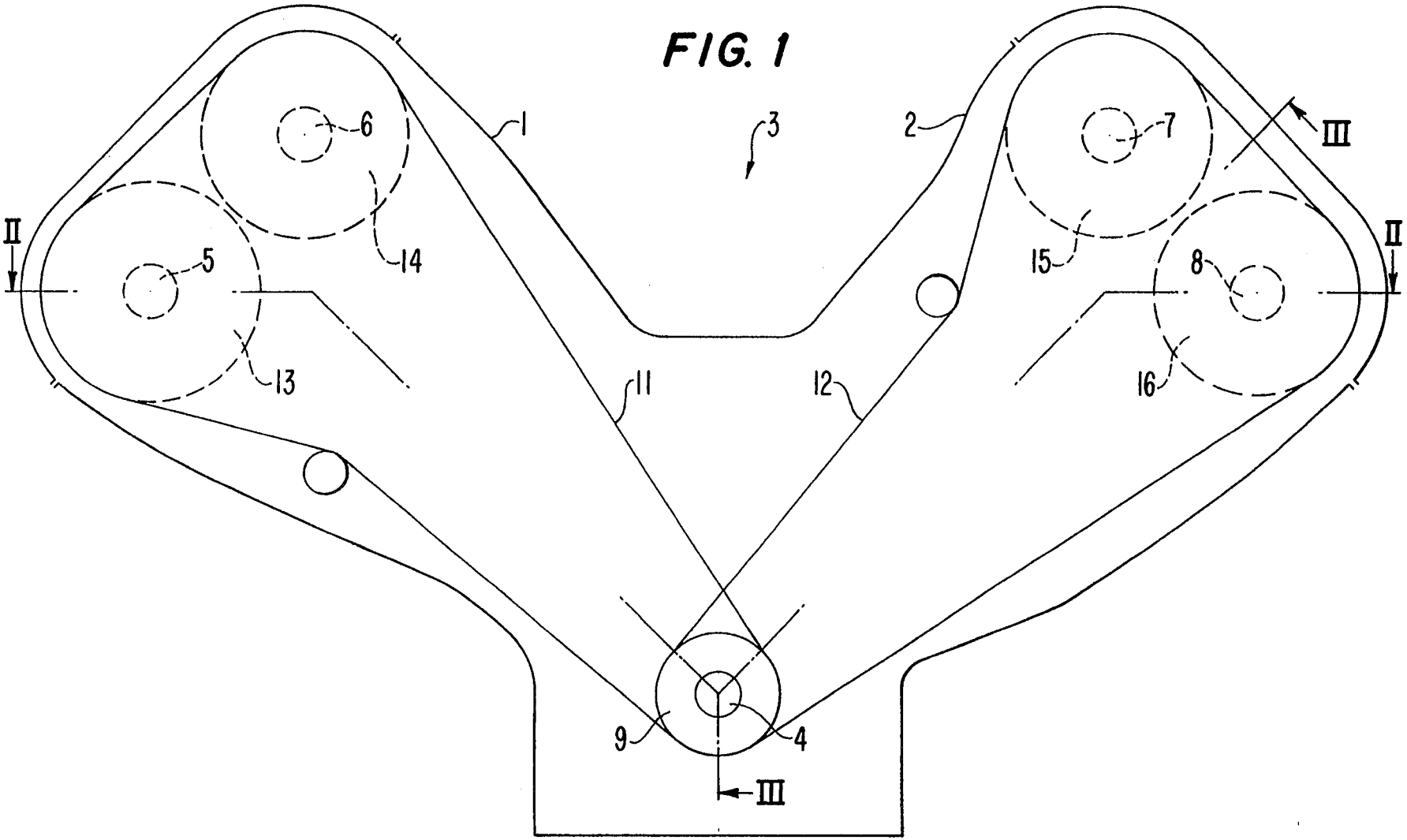
FIG. 1 is a view of an internal-combustion V-engine constructed in accordance with an embodiment of the present invention.
Figure 2:
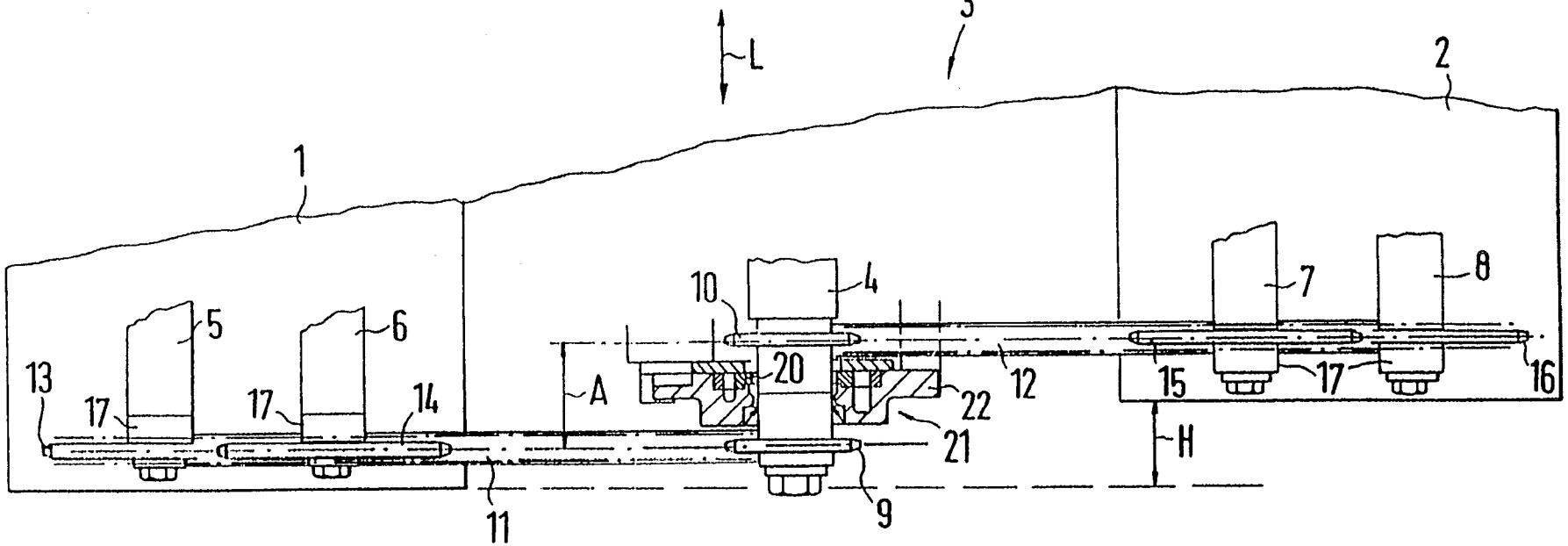
FIG. 2 is a sectional view along Line II—II according to FIG. 1.
Figure 3:
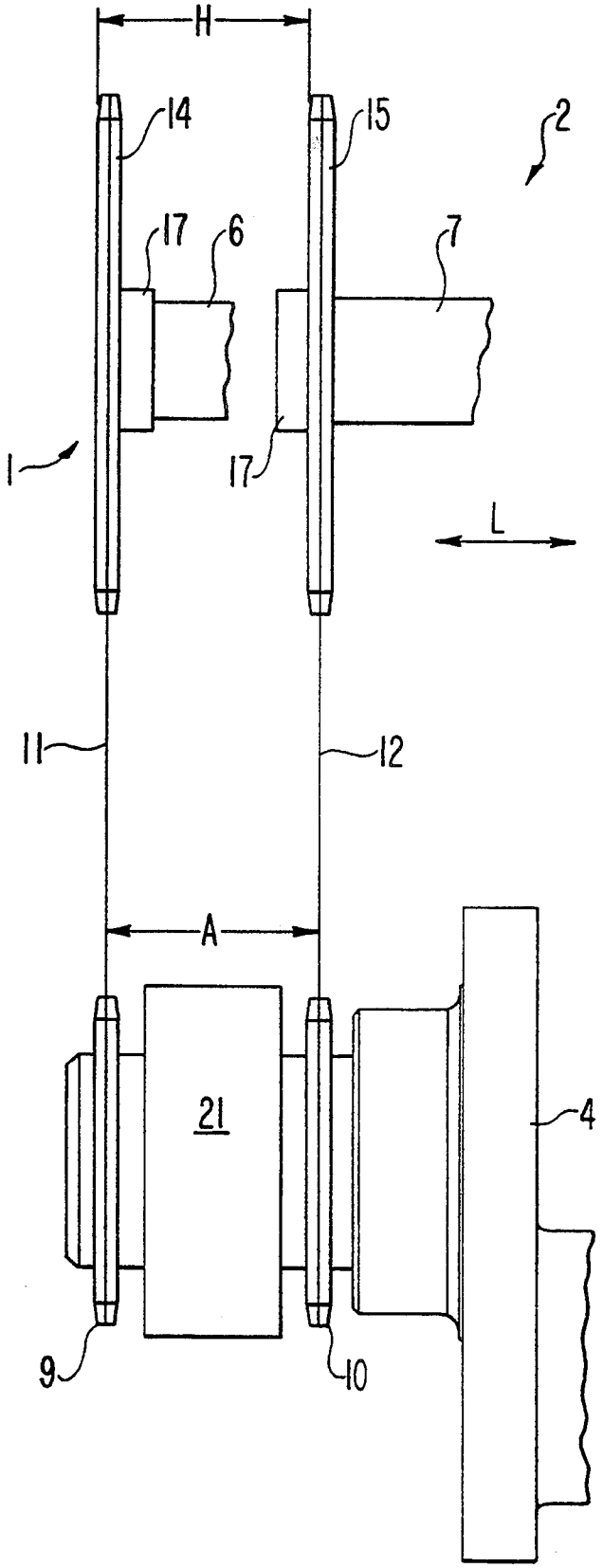
FIG. 3 is a schematic sectional view along Line III—III according to FIG. 1.

In the longitudinal direction L of the internal-combustion engine 3 (FIG. 2), the two cylinder banks 1, 2 have a offset H with respect to one another. On one end of the crankshaft, a first and a second output wheel 9 and 10 are arranged at a distance A with respect to one another. This distance is approximately identical to the offset H.

The output wheels 9 and 10 drive the camshafts 5, 6 and 7, 8 by chains 11 and 12. For this purpose, the camshafts 5 to 8 each have a driving wheel 13–16 each driving wheel 13–16 being equipped with a spacing sleeve 17 and constructed as identical parts. The first driving wheels 13, 14 which are assigned to the first cylinder bank 1 are mounted on the camshafts 5, 6 in such a manner that the spacing sleeves 17 face this first cylinder bank 1. The spacing sleeves 17 of the second driving wheels 15, 16 are mounted to be facing away from the second cylinder bank 2. In this manner, the second driving wheels 15, 16 are arranged to be offset by 180 degrees with respect to the first driving wheels 13, 14.

Between the two output wheels 9, 10, a gearwheel 20 is arranged on the crankshaft 4 as an additional output and forms a part of an oil pump 21 constructed as a curved pump. A housing 22 of this oil pump 21 is arranged coaxially with respect to the gearwheel 20.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A camshaft drive for an internal-combustion V-engine that has at least two cylinder banks, comprising:

at least one overhead camshaft for each cylinder bank;

a crankshaft;

a first output wheel non-rotatably mounted on the crankshaft and drivingly connected with the camshaft of one cylinder bank and a second output wheel non-rotatably mounted on the crankshaft and drivingly connected with the camshaft of the other cylinder bank;

first and second driving wheels mounted on the camshafts and driveably coupled to at least one of the first and second output wheels; and an additional output arranged between the first and second output wheels:

wherein the cylinder banks are offset from one another in a longitudinal direction of the V-engine, and the first and second output wheels are separated from one another in the longitudinal direction on the crankshaft by a distance that is approximately identical to the offset of the cylinder banks, and the driving wheels are identical parts.

2. A drive according to claim 1, wherein each of the driving wheels include a spacing sleeve, the spacing sleeve of the first driving wheel assigned to a first one of the cylinder banks arranged to face the first cylinder bank, and the spacing sleeve of the second driving wheel assigned to a second one of the cylinder banks arranged to face away from the second cylinder bank.

3. A drive according to claim 2, further comprising an auxiliary device arranged at a distance from the crankshaft and is driveably connected with the additional output.

4. A drive according to claim 3, wherein the additional output is a gearwheel and the auxiliary device is an oil pump.

5. A drive according to claim 4, further comprising an oil pump housing arranged coaxially with respect to the gearwheel.

* * * * *